US008622511B2

(12) United States Patent
Suzuki

(10) Patent No.: US 8,622,511 B2
(45) Date of Patent: Jan. 7, 2014

(54) IMAGE FORMING APPARATUS HAVING CARRIAGE MOUNTING RECORDING HEAD FOR EJECTING LIQUID DROPLETS

(75) Inventor: Kazuki Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/558,817

(22) Filed: Jul. 26, 2012

(65) Prior Publication Data

US 2013/0044158 A1 Feb. 21, 2013

(30) Foreign Application Priority Data

Aug. 16, 2011 (JP) ..... 2011-177912

(51) Int. Cl.
*B41J 2/165* (2006.01)

(52) U.S. Cl.
USPC ..... 347/30; 347/29; 347/32

(58) Field of Classification Search
USPC ..... 347/29, 30, 32
See application file for complete search history.

(56) References Cited

U.S. PATENT DOCUMENTS

| | | | | |
|---|---|---|---|---|
| 2001/0012027 | A1 | 8/2001 | Murcia et al. | |
| 2002/0047874 | A1* | 4/2002 | Uchida | 347/29 |
| 2002/0158941 | A1* | 10/2002 | Vega et al. | 347/35 |
| 2009/0015626 | A1 | 1/2009 | Murayama | |
| 2009/0015632 | A1 | 1/2009 | Suzuki et al. | |
| 2009/0122122 | A1 | 5/2009 | Kubo et al. | |
| 2010/0321426 | A1 | 12/2010 | Suzuki et al. | |
| 2011/0007112 | A1* | 1/2011 | Takei et al. | 347/37 |
| 2011/0090282 | A1 | 4/2011 | Miyazawa | |
| 2011/0249059 | A1 | 10/2011 | Takafuji | |
| 2012/0056932 | A1 | 3/2012 | Matsubara et al. | |

FOREIGN PATENT DOCUMENTS

| | | |
|---|---|---|
| EP | 2359941 A1 | 8/2011 |
| JP | 9-300644 | 11/1997 |
| JP | 11-300982 | 11/1999 |
| JP | 2006-96017 | 4/2006 |
| WO | WO2010/071041 | 6/2010 |

OTHER PUBLICATIONS

European search report dated Nov. 29, 2012 in connection with corresponding European patent application No. 12178325.2.

* cited by examiner

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus includes an apparatus body, a carriage, a first recording head, a second recording head, and a maintenance assembly. The carriage is movable in a main scanning direction. The first recording head has nozzles in a nozzle face thereof to eject liquid droplets. The second recording head has nozzles in a nozzle face thereof to eject liquid droplets. The second recording head is displaced from the first recording head in a sub scanning direction perpendicular to the main scanning direction. The maintenance assembly maintains and recovers the first recording head and the second recording head. The maintenance assembly includes a first maintenance device and a second maintenance device. The first maintenance device is held by the apparatus body. The second maintenance device is reciprocally movable between a first position to oppose the first recording head and a second position to oppose the second recording head.

4 Claims, 6 Drawing Sheets

IMAGE FORMING APPARATUS HAVING CARRIAGE MOUNTING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-177912, filed on Aug. 16, 2011 in the Japan Patent Office, the entire disclosure of which is hereby incorporated by reference herein.

BACKGROUND

1. Technical Field

This disclosure relates to an image forming apparatus, and more specifically to an image forming apparatus having a carriage mounting a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus is known that uses a recording head (liquid ejection head or liquid-droplet ejection head) for ejecting droplets of ink.

Such a liquid-ejection-type image forming apparatus may have a maintenance device (maintenance-and-recovery device) to maintain and recover the ejection stability of nozzles of the recording head. The maintenance device includes, for example, a suction cap to cap a nozzle face of the recording head for sucking and discharging liquid from the nozzles, a moisture retention cap to prevent drying of ink in the nozzles and incorporation of dust into the nozzles, and a wiper member (also referred to as wiper blade, wiping blade, or blade) to wipe and clean the nozzle face of the recording head. The maintenance device performs, for example, recovery operation to form nozzle menisci by wiping the nozzle face by the wiping member after viscosity-increased ink is discharged from the nozzles to the suction cap.

As a conventional type of maintenance device, for example, JP-09-300644-A proposes a maintenance device movable in a sub-scanning direction perpendicular to a main scanning direction between a maintenance position at which the maintenance device opposes the recording head mounted on the carriage to perform maintenance and recovery operation and a retreat position at which the maintenance device does not oppose the recording head.

To enhance the productivity, in an image forming apparatus, recording heads for ejecting the same color of liquid droplets are arranged in an offset manner so as to be placed at different positions in the sub-scanning direction, thus increasing the printing width of the recording heads in the sub-scanning direction at which the recording heads can print an image by a single main scanning operation. For the image forming apparatus, a maintenance device includes maintenance units arranged so that the respective recording heads displaced in the sub-scanning direction can oppose the corresponding maintenance units.

Such a configuration increases the number of components of the maintenance device and the space in the main scanning direction, thus increasing the width of the apparatus body (the apparatus size in the main scanning direction).

BRIEF SUMMARY

In an aspect of this disclosure, there is provided an image forming apparatus including an apparatus body, a carriage, a first recording head, a second recording head, and a maintenance assembly. The carriage is movable in a main scanning direction. The first recording head has nozzles in a nozzle face thereof to eject liquid droplets. The second recording head has nozzles in a nozzle face thereof to eject liquid droplets. The second recording head is displaced from the first recording head in a sub scanning direction perpendicular to the main scanning direction. The maintenance assembly maintains and recovers the first recording head and the second recording head. The maintenance assembly includes a first maintenance device and a second maintenance device. The first maintenance device is held by the apparatus body. The second maintenance device is reciprocally movable between a first position to oppose the first recording head and a second position to oppose the second recording head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
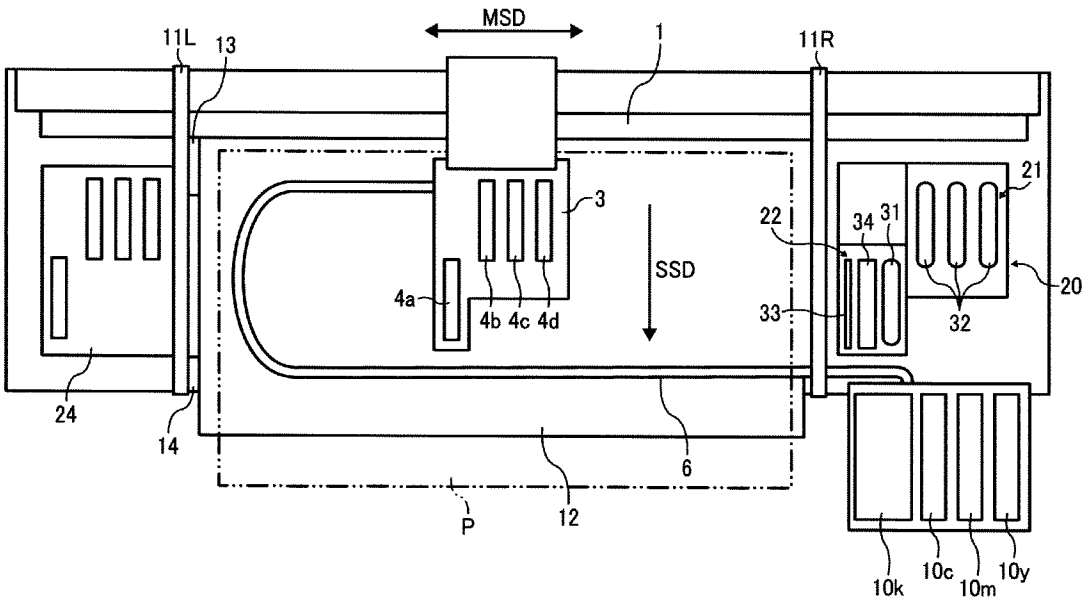
FIG. 1 is a partial plan view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The image forming apparatus is not limited to a vertical ejection type of image forming apparatus having a recording head to eject liquid droplets downward in the vertical direction, but may be, for example, a horizontal ejection type of image forming apparatus having a recording head to eject liquid droplets in a direction perpendicular to the vertical direction.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment is described below with reference to FIGS. 1 and 2.

Figure 2:
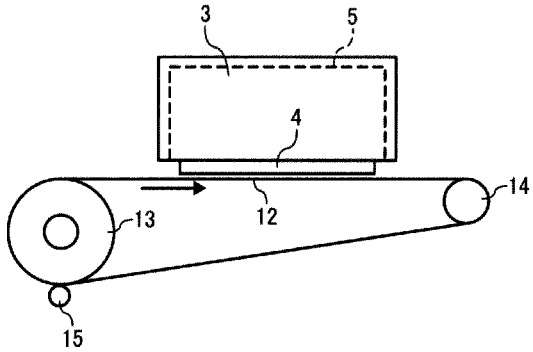
FIG. 2 is a partial front view of the mechanical section illustrated in FIG. 1.

FIG. 1 is a partial plan view of a mechanical section of the image forming apparatus. FIG. 2 is a partial side view of the mechanical section of FIG. 1.

In this exemplary embodiment, the image forming apparatus is described as a serial-type inkjet recording apparatus. In the image forming apparatus, a carriage 3 is supported by a main guide rod 1 and a sub guide rod so as to be movable in a main scanning direction indicated by an arrow MSD in FIG. 1. The main guide rod 1 and the sub guide rod extend between a left side plate 11L and a right side plate 11R. The carriage 3 is reciprocally moved for scanning in the main scanning direction MSD by a main scanning motor via a timing belt looped between a driving pulley and a driven pulley.

The carriage 3 mounts recording heads 4*a*, 4*b*, 4*c*, and 4*d* (collectively referred to as "recording heads 4" unless distinguished) formed with four liquid ejection heads for ejecting liquid droplets. The recording heads 4 are mounted on the carriage 3 so that multiple nozzle rows, each of which includes multiple nozzles, are arranged in parallel to the sub-scanning direction SSD perpendicular to the main scanning direction MSD and liquid droplets are ejected downward from the nozzles.

The recording head 4*a* is displaced from the recording heads 4*b* to 4*d* by a width of one head (one nozzle row) in the sub-scanning direction SSD perpendicular to the main scanning direction MSD. Each of the recording heads 4*a* to 4*d* has two nozzle rows. The recording heads 4*a* and 4*b* eject liquid droplets of the same black color, and the recording heads 4*c* and 4*d* eject liquid droplets of e.g., magenta (M), cyan (C), and yellow (Y) from respective nozzle rows.

As a result, monochrome images can be formed at a width of two heads by a single scanning (main scanning) operation of the recording heads 4*a* and 4*b*, and color images can be formed by, for example, the recording heads 4*b* to 4*d*.

Each of the recording heads 4*a* to 4*d* has a head tank 5 to supply liquid to each recording head 4. Respective color inks are supplied from the ink cartridges 10*k*, 10*c*, 10*m*, and 10*y* serving as main tanks replaceably mountable to the apparatus body, to the head tanks 5 via supply tubes 6.

The image forming apparatus has a conveyance belt 12 serving as a conveyance member to convey a sheet while attaching the sheet thereon by static electricity. The conveyance belt 12 is an endless belt that is looped between a conveyance roller 13 and a tension roller 14 so as to circulate in a belt conveyance direction (sub-scanning direction). A charging roller 15 charges (applies electric charges to) the conveyance belt 12 during circulation of the conveyance belt 12.

The conveyance roller 13 is circulated by a sub-scanning motor via a timing belt and a timing pulley, so that the conveyance belt 12 circulates in the sub-scanning direction indicated by an arrow SSD illustrated in FIG. 1.

At one end in the main scanning direction of the carriage 3, a maintenance assembly (maintenance-and-recovery assembly) 20 is disposed near a lateral side of the conveyance belt 12 to perform maintenance and recovery on the recording heads 4. At the opposite end in the main scanning direction, a first dummy ejection receptacle 24 is disposed near the opposite lateral side of the conveyance belt 12 to receive liquid droplets ejected from the recording heads 4 by dummy ejection in which liquid droplets not contributing to image formation are ejected for maintenance, e.g., removal of viscosity-increased liquid or bubbles.

As described below, the maintenance assembly 20 has a first maintenance device (first maintenance and recovery device) 21 supported by the apparatus body and a second maintenance device (second maintenance and recovery device) 22 supported by the apparatus body so as to be reciprocally movable. The maintenance assembly 20 includes, for example, a suction cap 31 also serving as a moisture-retention cap to cap the nozzle face of the recording head 4*a* and suck liquid from the nozzle face of the recording head 4*a*, moisture-retention caps 32 to cap the nozzle faces of the recording heads 4*b* to 4*d*, a wiper member 33 to wipe the nozzle faces of the recording heads 34, and a second dummy ejection receptacle 34 to receive liquid droplets ejected by dummy ejection in which liquid droplets not contributing to recording are ejected to remove viscosity-increased recording liquid.

In the image forming apparatus having the above-described configuration, a sheet P is fed from a sheet feed tray, attached on the conveyance belt 12 charged, and conveyed in the sub-scanning direction SSD with the circulation of the conveyance belt 12. By driving the recording heads 4 in response to image signals while moving the carriage 3 in the main scanning direction MSD, liquid droplets are ejected onto the sheet P, which is stopped below the recording heads 4, to form one line of a desired image. Then, the sheet P is fed by a certain distance to prepare for the next operation to record another line of the image. Receiving a signal indicating that the image recording has been completed or the rear end of the sheet P has arrived at the recording area, the recording heads 4 finish the recording operation and the sheet P is output to a sheet output tray.

Next, the maintenance assembly 20 according to the first exemplary embodiment of this disclosure is further described with reference to FIGS. 3 and 4.

Figure 3:
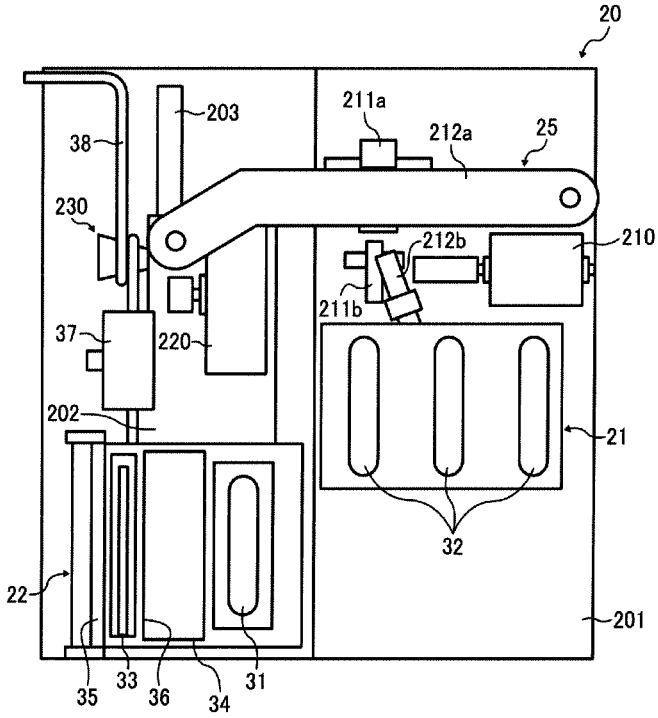
FIG. 3 is a plan view of a maintenance assembly in a state in which a second maintenance device is placed at a second position.
Figure 4:
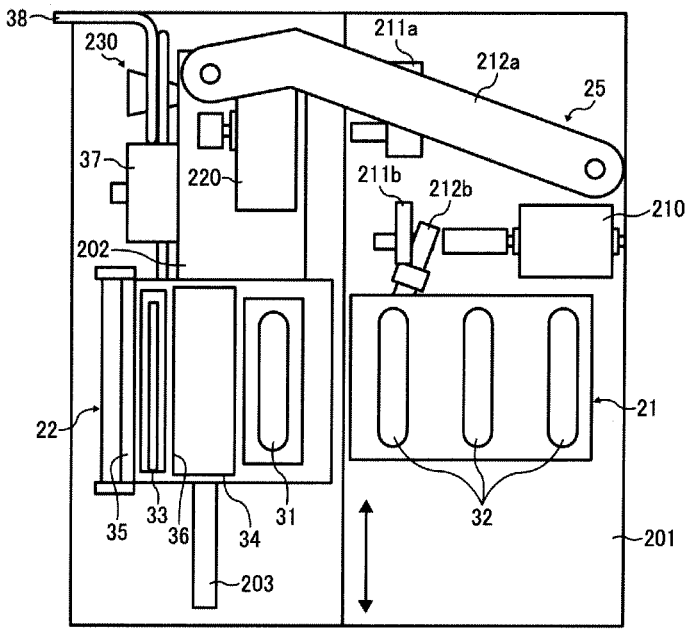
FIG. 4 is a plan view of the maintenance assembly in a state in which the second maintenance device is placed at a first position.

FIG. 3 is a plan view of the maintenance assembly in a state in which the second maintenance device (suction cap) is placed at a second position. FIG. 4 is a plan view of the maintenance assembly in a state in which the second maintenance device (suction cap) is placed at a first position.

In this exemplary embodiment, as described above, one of the recording heads 4*a* to 4*d* is displaced from the others of the recording heads 4*a* to 4*d* in the sub-scanning direction by the length of one nozzle row on the carriage 3 (hereinafter, also referred to as "offset arrangement"). Here, the recording heads 4*b* to 4*d* disposed at the upstream side in the sub-scanning direction (sheet conveyance direction) are referred to as first recording heads, and the recording head 4*a* disposed at the downstream side in the sub-scanning direction is referred to as a second recording head.

The maintenance assembly 20 has the first maintenance device 21 supported by the apparatus body and the second maintenance device 22 supported by the apparatus body so as to be reciprocally movable.

The first maintenance device 21 includes the three moisture-retention caps 32 corresponding to the respective recording heads 4*b* to 4*d* at such positions that the moisture-retention caps 32 can cap the recording heads 4*b* to 4*d* serving as the first recording heads.

The second maintenance device 22 includes the suction cap 31, the wiper member 33, a first wiper cleaner 35, and the second dummy ejection receptacle 34 with a second wiper cleaner 36. The second maintenance device 22 is reciprocally movable between the first position illustrated in FIG. 4 and the second position illustrated in FIG. 3. At the first position of FIG. 4, the second maintenance device 22 perform maintenance and recovery operation on the recording heads 4*b* to 4*d* serving as the first recording heads. At the second position of FIG. 3, the second maintenance device 22 perform maintenance and recovery operation on the recording head 4*a* serving as the second recording head.

Specifically, the apparatus body mounts a maintenance frame 201 of the entire maintenance assembly 20. The first maintenance device 21 is mounted on the maintenance frame 201. In addition, a driving device 25 is disposed on the maintenance frame 201. The driving device 25 includes an advancing and retreating unit to advance and retreat the moisture-retention caps 32 of the first maintenance device 21 (in this example, move the moisture-retention caps 32 upward and downward) relative to the recording heads 4*b* to 4*d* and a reciprocal moving unit to reciprocally move the second maintenance device 22.

Furthermore, a sliding frame 202 serving as a sliding member is disposed on the maintenance frame 201 so as to be reciprocally movable in the sub-scanning direction. The sliding frame 202 is movable along a guide rail 203 arranged in the sub-scanning direction on the maintenance frame 201. The second maintenance device 22 is disposed on the sliding frame 202.

Thus, the second maintenance device 22 is reciprocally movable between the first position at which, e.g., the suction cap 31 can oppose the recording heads 4*b* to 4*d* and the second position at which, e.g., the suction cap 31 can oppose the recording head 4*a*.

In addition, for example, a suction pump 37 and a reeling device 230 are disposed on the sliding frame 202. The suction pump 37 is a tubing pump serving as a suction device connected to the suction cap 31 of the second maintenance device 22. The reeling device 230 reels a discharging tube 38, formed with a flexible tube, of the suction pump 37. The discharging tube 38 is connected to the waste-liquid tank 250 of the apparatus body illustrated in FIGS. 5A and 5B.

The suction cap 31 is held by a cap holder, and advanced and retreated (in this example, moved upward and downward) relative to the recording heads 4 by the advancing and retreating unit. The wiper member 33 is held by a wiper holder, and advanced and retreated (in this example, moved upward and downward) relative to the recording heads 4 by the advancing and retreating unit.

The movement of the sliding frame 202 (reciprocal movement of the second maintenance device 22) and the advance and retreat operation (upward and downward movement) of the moisture-retention caps 32 relative to the recording heads 4*b* to 4*d* via the driving device 25 is performed by the forward and reverse rotation of a first motor 210 and the drive switching of two one-way clutches. In this exemplary embodiment, for the movement of the sliding frame 202 and the upward and downward movement of the moisture-retention caps 32, rotational motion is converted to linear motion by eccentric cams 211*a*, 211*b* and arms 212*a*, 212*b*, respectively.

The advance and retreat operation of the suction cap 31 relative to the recording heads 4 and the driving of the suction pump 37 are performed by the forward and reverse rotation of a second motor 220 and the drive switching of a one-way clutch.

Next, the maintenance and recovery operation (maintenance operation) of maintaining and recovering the recording heads by the maintenance device is described with reference to FIGS. 5A and 5B.

Figure 5A:
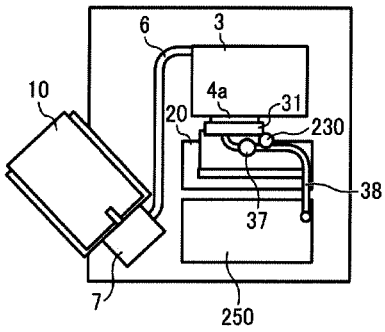
FIG. 5A is a side view of the image forming apparatus during maintenance and recovery operation (maintenance operation) on a second recording head.

FIG. 5A is a side view of the image forming apparatus during maintenance and recovery operation on the second recording head. FIG. 5B is a side view of the image forming apparatus during maintenance and recovery operation on the first recording heads.

When maintenance and recovery operation is performed on the recording head 4*a* serving as the second recording head, the second maintenance device 22 is placed at the second position illustrated in FIG. 5A and the carriage 3 is moved to a position opposing the second maintenance device 22. The suction cap 31 is moved upward to cap the nozzle face of the recording head 4*a*, and viscosity-increased liquid is sucked and discharged from the nozzles of the recording head 4*a*. After the suction cap 31 is separated (decapped) from the nozzles of the recording head 4*a*, liquid droplets (dummy ejection droplets) not contributing to image formation are discharged to the second dummy ejection receptacle 34 by dummy ejection. The wiper member 33 is moved upward to wipe the nozzle face. Thus, the maintenance and recovery operation is performed.

Figure 5B:
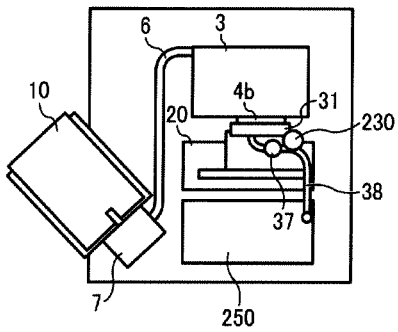
FIG. 5B is a side view of the image forming apparatus during maintenance and recovery operation on first recording heads.

When maintenance and recovery operation is performed on the recording head 4*b* serving as the first recording head, the second maintenance device 22 is placed at the first position illustrated in FIGS. 3 and 5B and the carriage 3 is moved to the position opposing the second maintenance device 22. The suction cap 31 is moved upward to cap the nozzle face of the recording head 4*b*, and viscosity-increased liquid is sucked and discharged from the nozzles of the recording head 4*b*. After the suction cap 31 is separated (decapped) from the nozzles of the recording head 4*b*, liquid droplets (dummy ejection droplets) not contributing to image formation are discharged to the second dummy ejection receptacle 34 by dummy ejection. The wiper member 33 is moved upward to wipe the nozzle face. Thus, the maintenance and recovery operation is performed. Maintenance and recovery operation on the recording heads 4*c* and 4*d* is performed in the same manner as that on the recording head 4*b*.

Next, operation effect of the first exemplary embodiment is described with reference to FIGS. 6A, 6B, 7A, and 7B.

Figure 6A:
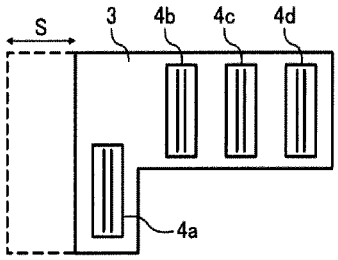
FIGS. 6A and 6B are schematic plan views of the first exemplary embodiment.
Figure 6B:
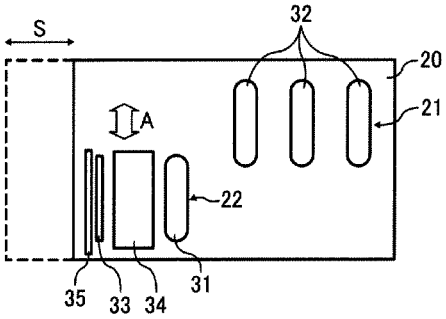
Figure 7A:
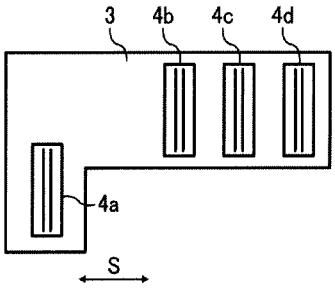
FIGS. 7A and 7B are schematic plan views of a first comparative example.
Figure 7B:
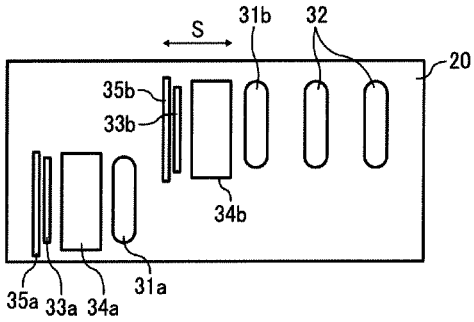

FIGS. 6A and 6B are schematic plan views of the first exemplary embodiment. FIGS. 7A and 7B are schematic plan views of a first comparative example. FIG. 6A is also a schematic plan view of the carriage. FIG. 6B is a schematic view of the maintenance device.

In the first comparative example, as illustrated in FIG. 7A, a recording head 4*a* and recording heads 4*b* to 4*d* are mounted on a carriage 3 in offset arrangement.

As a result, as illustrated in FIG. 7B, to perform maintenance and recovery operation on the recording heads 4*b* to 4*d*, a maintenance device 20 includes, for example, a suction cap 31*b* to suck liquid from the recording heads 4*b* to 4*d* and retain moisture in the recording head 4*b*, moisture-retention caps 32 to retain moisture in the respective recording heads 4*c* and 4*d*, a wiper member 33*b* to wipe the recording heads 4*b* to 4*d*, a second dummy ejection receptacle 34*b*, and a wiper cleaner 35*b* to clean the wiper member 33*b*.

To perform maintenance and recovery operation on the recording head 4*a*, the maintenance device 20 further includes a suction cap 31*a* to suck liquid from and retain moisture in the recording head 4*a*, a wiper member 33*a* to wipe the recording head 4*a*, a second dummy ejection receptacle 34*a*, and a first wiper cleaner 35*a* to clean the wiper member 33*a*.

In such a case, to prevent interference of the recording head 4*a* with the wiper member 33*b*, the second dummy ejection receptacle 34*b*, and the wiper cleaner 35*b* of the maintenance device 20, the recording head 4*a* is disposed away from the recording head 4*b* at a distance corresponding to a width S at which the wiper member 33*b*, the second dummy ejection receptacle 34*b*, and the wiper cleaner 35*b* are arranged in the main scanning direction.

By contrast, in this exemplary embodiment, as illustrated in FIGS. 6A and 6B, to perform maintenance and recovery operation on the recording heads 4*a* to 4*d*, the maintenance device 20 includes the suction cap 31 to suck liquid from the recording heads 4*a* to 4*d* and retain moisture in the recording head 4*a*, the wiper member 33 to wipe the recording heads 4*a* to 4*d*, the second dummy ejection receptacle 34, the first wiper cleaner 35 to clean the wiper member 33, and the moisture-retention caps 32 to retain moisture in the recording heads 4*b* to 4*d*. As described above, the second maintenance device 22 including the suction cap 31, the wiper member 33, the second dummy ejection receptacle 34, and the first wiper cleaner 35 is reciprocally movable in a direction indicated by an arrow A in FIG. 6B.

In other words, the configuration of this exemplary embodiment obviates the wiper member 33*b* to wipe the recording heads 4*b* to 4*d*, the second dummy ejection receptacle 34*b*, and the wiper cleaner 35*b* in the configuration of the first comparative example.

As a result, in this exemplary embodiment, as compared to the first comparative example, the length of each of the carriage 3 and the maintenance device 20 in the main scanning direction can be reduced by the width S required to arrange the wiper member 33*b*, the second dummy ejection receptacle 34*b*, and the wiper cleaner 35*b* of the first comparative example in the main scanning direction.

Thus, in a case in which at least one of multiple recording heads is shifted from the other(s) in the sub-scanning direction, the above-described configuration of this exemplary embodiment can reduce the number of components and required space of the maintenance device, thus minimizing the apparatus size.

It is to be noted that the second maintenance device does not necessarily need to include all of the suction cap, the wiping member, and the dummy ejection receptacle but may include at least one of the suction cap, the wiping member, and the dummy ejection receptacle to obtain the above-described operation effect.

Next, a second exemplary embodiment of this disclosure is described with reference to FIGS. 8A, 8B, 9A, and 9B.

Figure 8A:
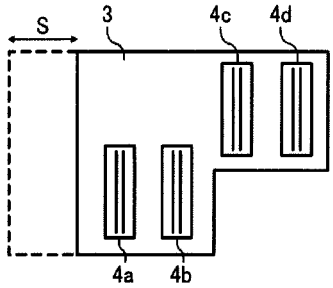
FIGS. 8A and 8B are schematic plan views of a second exemplary embodiment.
Figure 8B:
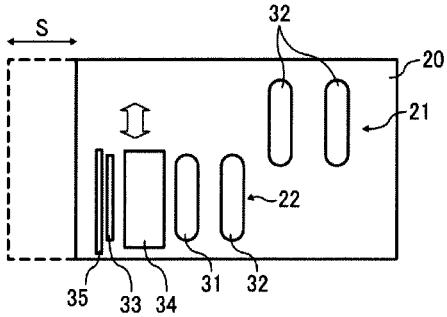
Figure 9A:
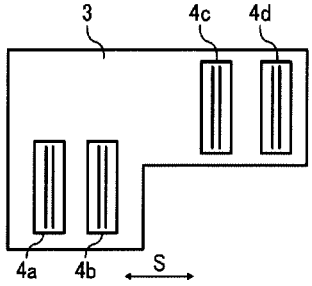
FIGS. 9A and 9B are schematic plan views of a second comparative example.
Figure 9B:
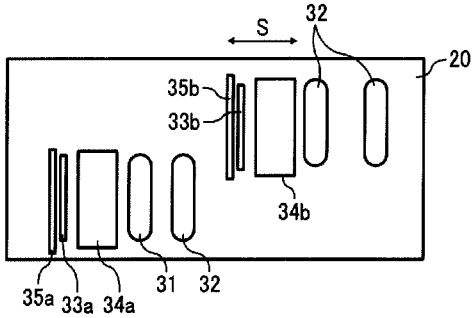

FIGS. 8A and 8B are schematic plan views of the second exemplary embodiment. FIGS. 9A and 9B are schematic plan views of a second comparative example.

For this second exemplary embodiment and the second comparative example, the recording head 4*b* of the first exemplary embodiment and the first comparative example is disposed near the recording head 4*a*. In other words, in this second exemplary embodiment and the second comparative example, the recording heads 4*c* and 4*d* serve as first recording heads and the recording heads 4*a* and 4*b* serve as second recording heads.

Such a configuration of this second exemplary embodiment obviates a wiper member 33*b* to wipe the recording heads 4*c* and 4*d*, a second dummy ejection receptacle 34*b*, and a wiper cleaner 35*b* of the second comparative example.

As a result, in this second exemplary embodiment, as compared to the second comparative example, the length of each of the carriage 3 and the maintenance device 20 in the main scanning direction can be reduced by a width S required to arrange the wiper member 33*b*, the second dummy ejection receptacle 34*b*, and the wiper cleaner 35*b* of the second comparative example in the main scanning direction.

Thus, in a case in which at least one of multiple recording heads is displaced from the other(s) in the sub-scanning direction, the above-described configuration of this exemplary embodiment can reduce the number of components and required space of the maintenance device, thus minimizing the apparatus size.

Next, a third exemplary embodiment of this disclosure is described with reference to FIGS. 10 to 12.

Figure 10:
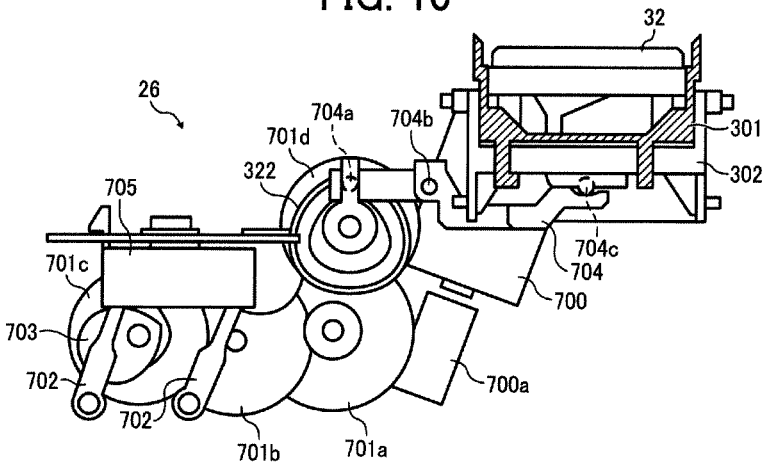
FIG. 10 is a side view of a driving device to drive moisture-retention caps and a second maintenance device in the second exemplary embodiment.

FIG. 10 is a side view of a driving device to drive moisture-retention caps and a second maintenance device in the second exemplary embodiment. FIG. 11 is a side view of an advancing and retreating unit of the driving device to advance and retreat the moisture-retention caps. FIG. 12 is a side view of a reciprocal moving unit of the driving device to reciprocally move the second maintenance device.

Moisture-retention caps 32 are held by a cap holder 301, and the cap holder 301 is held by a slider 302. The slider 302 is held by a maintenance frame of a maintenance device 20 so as to be movable (in this example, upward and downward).

When a direct current (DC) motor 700 rotates in a normal direction, a driving device 26 rotates a slide cam 703 via a worm gear 700*a* fixed at an output shaft of the DC motor 700 and gears 701*a*, 701*b*, 701*c*, and 701*d*, thus reciprocally moving a slide member 705. As a result, a second maintenance device 22 mounted on the slide member 705 is reciprocally moved in the sub-scanning direction (horizontal direction in FIGS. 10 to 12).

By contrast, when the DC motor 700 is rotated in a reverse direction, the gears 701*a*, 701*b*, 701*c*, and 701*d* rotate in reverse to rotate a cap cam 322. Rotation of the cap cam 322 causes the moisture-retention caps 32 of a first maintenance device 21 to advance and retreat (in this case, move upward and downward) via a cap lever 704.

A one-way clutch is mounted on a shaft of the slide cam 703 and the cap cam 322 to transmit the rotation of the slide cam 703 and the cap cam 322 in one direction.

Figure 11:
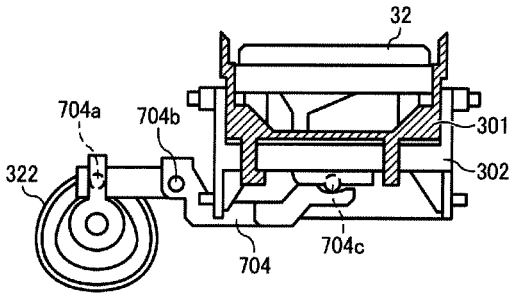
FIG. 11 is a side view of an advancing and retreating unit of the driving device of FIG. 10 to advance and retreat the moisture-retention caps.

Specifically, as illustrated in FIG. 11, a boss 704*a* at one end of the cap lever 704 is movably fitted in a groove (cam groove) of the cap cam 322. The cap lever 704 can swing around a support shaft 704*b*. A boss 704*c* at the opposite end of the cap lever 704 is rotatably fitted in the slider 302. Swinging of the cap lever 704 causes the moisture-retention caps 32 to move upward and downward.

Figure 12:
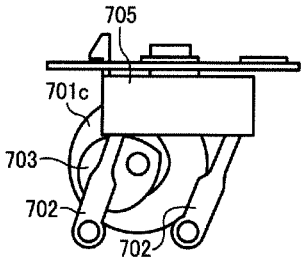
FIG. 12 is a side view of a reciprocal moving unit of the driving device of FIG. 10 to reciprocally move the second maintenance device.

As illustrated in FIG. 12, one end of each of slide levers 702 is rotatably mounted on the slide member 705, and the opposite end of each of the slide levers 702 is rotatably supported, thus allowing each slide lever 702 to swing. A portion of one of the slide levers 702 is movably fitted in a cam groove of the slide cam 703. Rotation of the slide cam 703 causes the slide member 705 to reciprocally move in the sub-scanning direction (horizontal direction in FIG. 12) via the slide levers 702.

As described above, the third exemplary embodiment moves the moisture-retention caps and the second maintenance device by a single driving source, thus providing a simple configuration.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an apparatus body;

a carriage movable in a main scanning direction;

a first recording head having nozzles in a nozzle face thereof to eject liquid droplets;

a second recording head, having nozzles in a nozzle face thereof to eject liquid droplets, the second recording head displaced from the first recording head in a sub scanning direction perpendicular to the main scanning direction; and a maintenance assembly to maintain and recover the first recording head and the second recording head, the maintenance assembly including (i) a first maintenance device held by the apparatus body and (ii) a second maintenance device reciprocally movable in the sub-scanning direction between a first position to oppose the first recording head and a second position to oppose the second recording head, wherein the first maintenance device is disposed adjacent to the second maintenance device in the main scanning direction, and when the second maintenance device is at the first position, the second maintenance device is displaced from the first maintenance device in the sub-scanning direction, and when the second maintenance device is at the second position, the second maintenance device is disposed at same position as the first maintenance device in the sub-scanning direction.

2. The image forming apparatus of claim 1, wherein the second maintenance device includes at least one of a wiper member to wipe the nozzle face of the first recording head and the nozzle face of the second recording head, a suction cap to seal the nozzle face of the first recording head and the nozzle face of the second recording head and connected to a sucking device, and a dummy ejection receptacle to receive liquid droplets not contributing to image formation.

3. The image forming apparatus of claim 1, further comprising:

a moisture-retention cap disposed in the first maintenance device to seal the nozzle face of the first recording head, the moisture-retention cap movable to advance and retreat relative to the first recording head;

an advancing and retreating unit to advance and retreat the moisture-retention cap relative to the first recording head;

a reciprocal moving unit to reciprocally move the second maintenance device; and a common driving source to drive the advancing and retreating unit and the reciprocal moving unit.

4. The image forming apparatus of claim 1, wherein the first maintenance device includes at least one first cap, and the second maintenance device includes at least one second cap, each of the at least one first cap is constituted by a corresponding moisture retention cap, each of the at least one second cap is movable in the sub scanning direction and includes at least one suction cap, and the first cap and the second cap are configured to separately seal the first recording head and the second recording head, respectively.

* * * * *